US008955264B2

(12) United States Patent
Edwards et al.

(10) Patent No.: US 8,955,264 B2
(45) Date of Patent: Feb. 17, 2015

(54) PORTABLE TOWER WITH IMPROVED GUIDING AND LIFTING SYSTEMS

(71) Applicant: Solaris Technologies, Inc., Irving, TX (US)

(72) Inventors: Jonathan Edwards, Red Oak, TX (US); Jose Manuel Villasenor, Huixquelucan (MX)

(73) Assignee: Solaris Technologies, Inc., Irving, TX (US)

( * ) Notice: Subject to any disclaimer, the term of this patent is extended or adjusted under 35 U.S.C. 154(b) by 0 days.

(21) Appl. No.: 13/875,137

(22) Filed: May 1, 2013

(65) Prior Publication Data

US 2014/0318040 A1 Oct. 30, 2014

Related U.S. Application Data

(60) Provisional application No. 61/815,611, filed on Apr. 24, 2013.

(51) Int. Cl.
*E04H 12/34* (2006.01)
*E04H 12/18* (2006.01)

(52) U.S. Cl.
CPC ..... *E04H 12/182* (2013.01); *E04H 12/34* (2013.01)
USPC ..... 52/118; 52/632

(58) Field of Classification Search
USPC ..... 52/118, 121, 146, 110, 111, 117, 632
See application file for complete search history.

(56) References Cited

U.S. PATENT DOCUMENTS

| | | | | | |
|---|---|---|---|---|---|
| 2,742,260 | A * | 4/1956 | Patterson | 254/399 |
| 2,905,280 | A * | 9/1959 | Weaver | 52/118 |
| 2,948,363 | A * | 8/1960 | Hopfeld | 182/141 |
| 3,439,467 | A * | 4/1969 | Partlow | 52/632 |
| 3,561,711 | A * | 2/1971 | Dodge | 248/163.1 |
| 4,151,534 | A * | 4/1979 | Bond | 343/883 |
| 4,417,424 | A * | 11/1983 | Jacobson | 52/108 |
| 4,580,377 | A * | 4/1986 | Sundin | 52/121 |
| 4,815,757 | A * | 3/1989 | Hamilton | 280/764.1 |
| 4,932,176 | A * | 6/1990 | Roberts et al. | 52/118 |
| 5,101,215 | A * | 3/1992 | Creaser, Jr. | 343/883 |
| 5,244,346 | A * | 9/1993 | Fergusson | 416/142 |
| 5,426,444 | A * | 6/1995 | Sauter et al. | 343/883 |
| 5,537,125 | A * | 7/1996 | Harrell et al. | 343/878 |
| 5,786,854 | A * | 7/1998 | Slade et al. | 348/373 |
| RE37,559 | E * | 2/2002 | Marue et al. | 248/405 |
| 7,062,883 | B1 * | 6/2006 | Langholz et al. | 52/110 |
| 7,089,705 | B1 * | 8/2006 | Lieberman | 52/146 |
| 7,231,741 | B2 * | 6/2007 | Norwood | 52/118 |
| 7,568,315 | B2 * | 8/2009 | Norwood | 52/118 |
| 7,574,832 | B1 * | 8/2009 | Lieberman | 52/118 |
| 7,768,473 | B2 * | 8/2010 | Kardohely | 343/883 |

(Continued)

OTHER PUBLICATIONS

"ToughTower, Quick Deploy Tower", Solaris Technologies, 2012, 2 pages.

*Primary Examiner* — James Ference

(57) ABSTRACT

An apparatus includes a portable tower having multiple sections including a base section and at least two slidable sections. The sections form a nested telescopic structure where each of the slidable sections is configured to move within another of the sections. The tower can also include a lifting system configured to extend the at least two slidable sections substantially simultaneously. Each section of the tower may also include multiple rollers configured to roll against at least one adjacent section of the tower.

21 Claims, 16 Drawing Sheets

(56) References Cited

U.S. PATENT DOCUMENTS

| | | | | |
|---|---|---|---|---|
| 7,774,994 | B2 * | 8/2010 | Battaglia | 52/121 |
| 7,966,777 | B2 * | 6/2011 | Douglas et al. | 52/118 |
| 8,046,970 | B2 * | 11/2011 | Diniz et al. | 52/632 |
| 8,234,823 | B2 * | 8/2012 | McClure et al. | 52/111 |
| 8,288,973 | B2 * | 10/2012 | Ford | 318/277 |
| 8,365,471 | B2 * | 2/2013 | Diniz et al. | 52/1 |
| 8,467,741 | B2 * | 6/2013 | Newman | 455/95 |
| 2002/0139064 | A1 * | 10/2002 | Norwood | 52/118 |
| 2003/0161622 | A1 * | 8/2003 | Zantos | 396/419 |
| 2006/0028390 | A1 * | 2/2006 | Norwood | 343/874 |
| 2007/0028532 | A1 * | 2/2007 | Douglas et al. | 52/118 |
| 2007/0298919 | A1 * | 12/2007 | Bianchi et al. | 474/64 |
| 2008/0236060 | A1 * | 10/2008 | Battaglia | 52/121 |
| 2010/0251634 | A1 * | 10/2010 | Diniz et al. | 52/121 |
| 2010/0313494 | A1 * | 12/2010 | Ford | 52/111 |
| 2012/0228442 | A1 * | 9/2012 | Clifton | 248/163.1 |

* cited by examiner

PORTABLE TOWER WITH IMPROVED GUIDING AND LIFTING SYSTEMS

CROSS-REFERENCE TO RELATED APPLICATION AND PRIORITY CLAIM

This application claims priority under 35 U.S.C. §119(e) to U.S. Provisional Patent Application No. 61/815,611, which is hereby incorporated by reference in its entirety.

TECHNICAL FIELD

This disclosure relates generally to portable telescopic towers. More specifically, this disclosure relates to a portable tower with improved guiding and lifting systems.

BACKGROUND

Various types of towers are routinely used in numerous types of environments. For example, mobile devices typically receive wireless services from one or more nearby communication towers. However, there are times when a given area lacks adequate communication resources for mobile devices. For instance, a large number of mobile devices may be present in a given area on a temporary basis. Specific examples of this can include large gatherings of people, such as in sporting and entertainment venues or during disaster recovery efforts. The presence of such a large number of mobile devices can overwhelm existing communication resources. This becomes particularly problematic if existing communication resources have been damaged or destroyed, such as due to a natural disaster. As another example, remote locations such as oil fields and other worksites often have no fixed communication towers that can provide wireless services to mobile devices. Other uses for towers can include mounting for surveillance, solar power, or lighting equipment.

SUMMARY

This disclosure provides a portable tower with improved guiding and lifting systems.

In a first embodiment, an apparatus includes a portable tower having multiple sections including a base section and at least two slidable sections. The sections form a nested telescopic structure where each of the slidable sections is configured to move within another of the sections. The tower also includes a lifting system configured to extend the at least two slidable sections substantially simultaneously.

In a second embodiment, a system includes a portable tower having multiple sections including a base section and at least two slidable sections. The sections form a nested telescopic structure where each of the slidable sections is configured to move within another of the sections. The system also includes a trailer on which the portable tower in mounted. The tower also includes a lifting system configured to extend the at least two slidable sections substantially simultaneously.

In a third embodiment, an apparatus includes a portable tower having multiple sections including a base section and at least two slidable sections. The sections form a nested telescopic structure where each of the slidable sections is configured to move within another of the sections. Each section of the tower includes multiple rollers configured to roll against at least one adjacent section of the tower.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1A through 14, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1A:
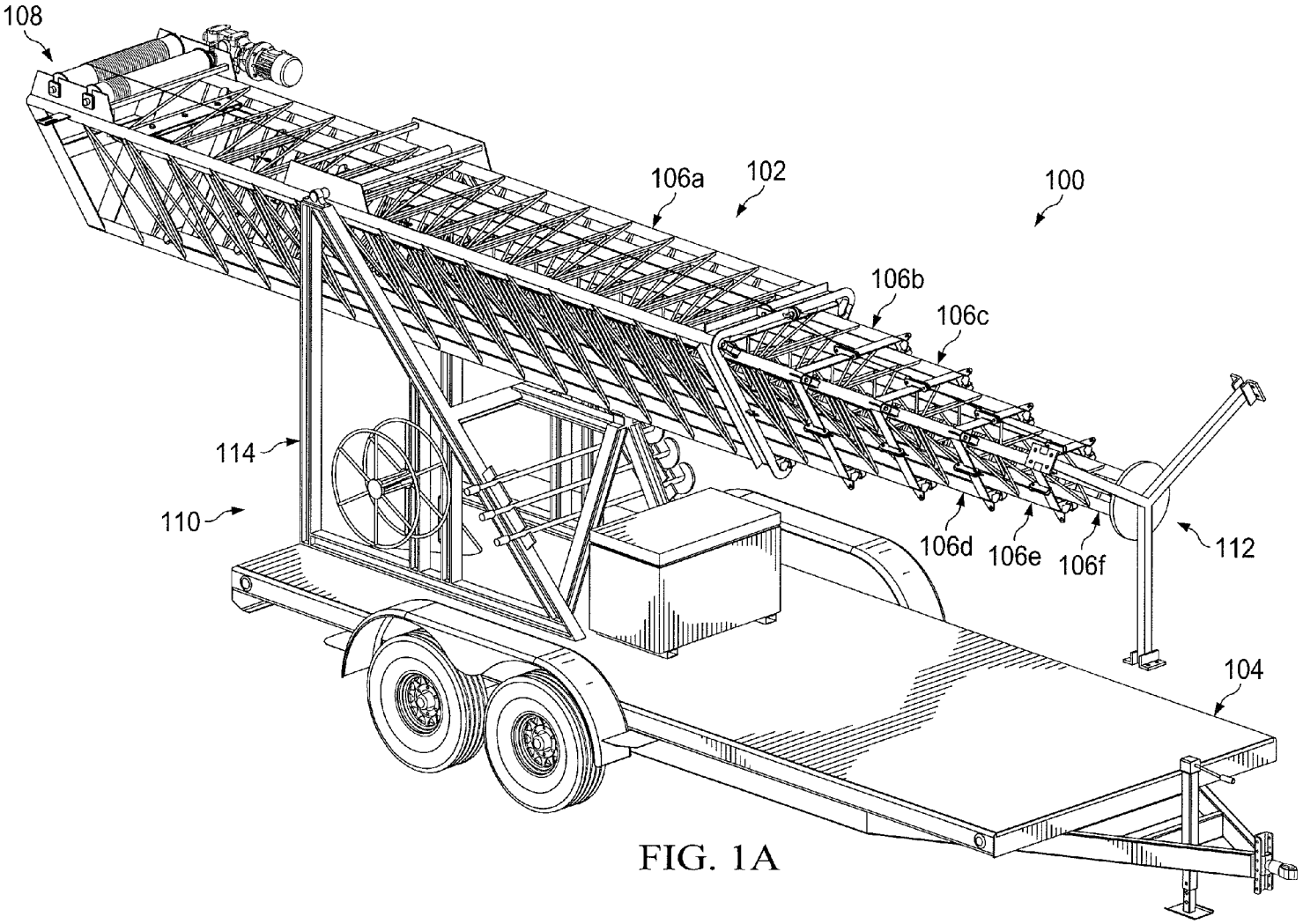
FIGS. 1A through 1C illustrate an example portable tower system according to this disclosure.
Figure 1B:
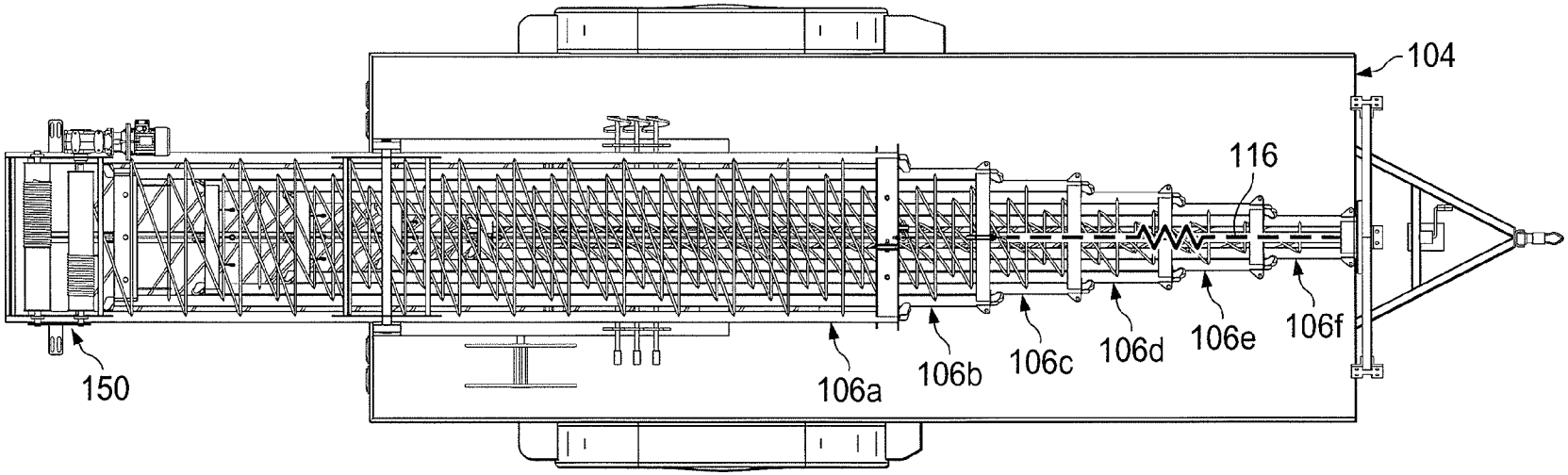
Figure 1C:
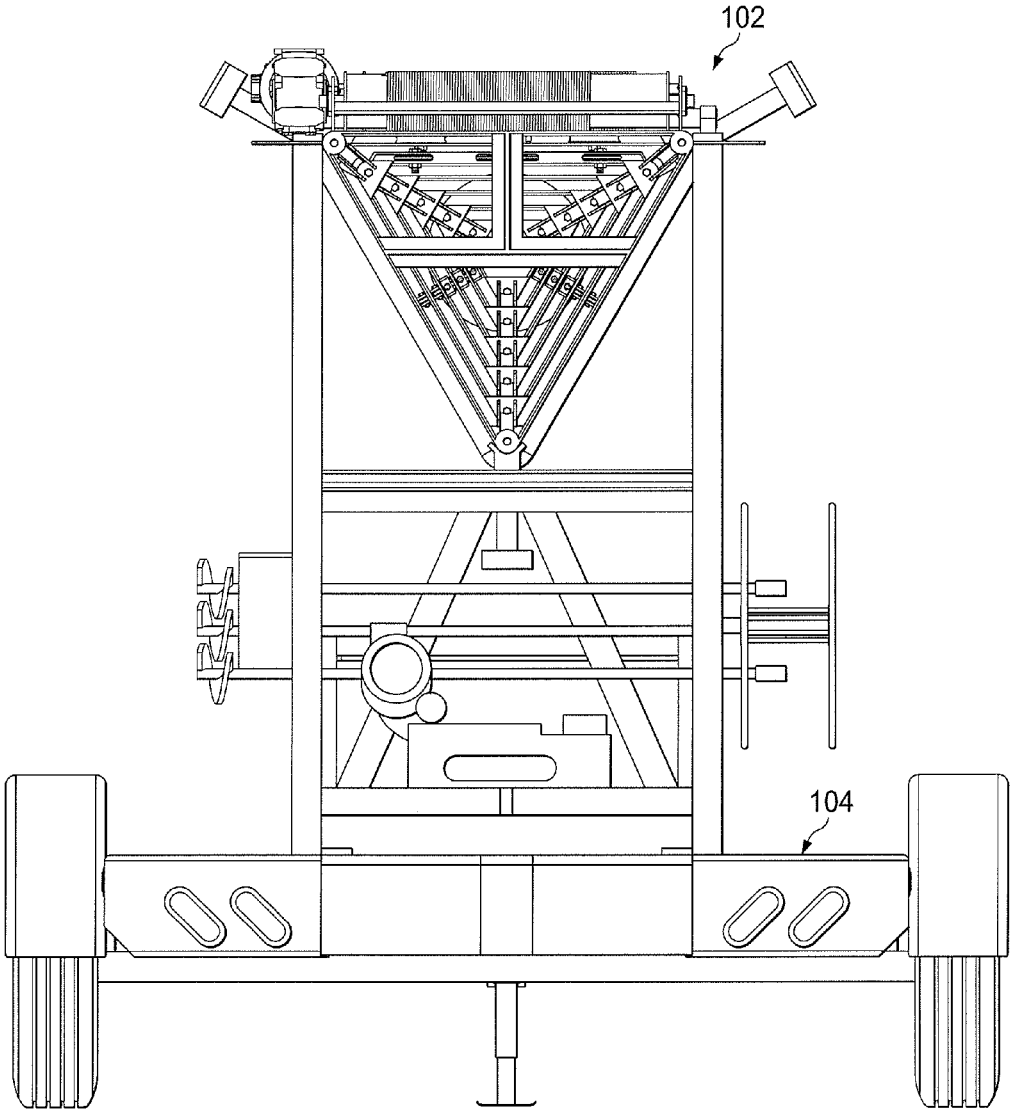

FIGS. 1A through 1C illustrate an example portable tower system 100 according to this disclosure. As shown in FIGS. 1A through 1C, the system 100 includes a tower 102 mounted on a trailer 104. The tower 102 generally represents a portable telescopic structure that can be raised or extended and lowered or retracted. The trailer 104 generally represents a portable base on which the tower 102 can be carried.

As shown in this example, the tower 102 represents a telescopic structure formed using multiple sections 106*a*-106*f*. These tower sections 106*a*-106*f* form a nested structure, where the section 106*b* fits substantially within the section 106*a*, the section 106*c* fits substantially within the section 106*b*, and so on. However, portions of each tower section 106*b*-106*f* can be extended out of a corresponding larger section 106*a*-106*e* to extend the tower 102. A base 108 of the tower 102 can be placed on the ground or other support structure when the tower 102 is rotated on the trailer 104, and the sections 106*b*-106*f* can be extended or retracted using equipment 110 on the trailer 104. A payload 112 at the end of the tower 102 can be used to provide wireless communication services, provide surveillance, support disaster recovery efforts, provide microwave communication or camera services, implement lighting solutions, provide solar power solutions or satellite solutions, or perform any other suitable function in which a tower might be necessary or desired.

The tower 102 includes any suitable number of sections, and each section could have any suitable size, shape, and dimensions. For example, each section 106*a*-106*f* could be ten to twenty feet in length, and the number of sections in the tower 102 can be based at least in part on the total height needed for the payload 112. Each section 106*a*-106*f* could also be formed from any suitable material(s), such as galvanized 2.375" outer diameter schedule 40 steel pipes arranged in a lattice configuration. Note, however, that pipes of different diameters can be used in different sections 106*a*-106*f* of the tower 102.

In the following description, the bottom section 106*a* of the tower 102 is generally referred to as the "base" section. This is because the section 106*a* is connected to the base 108 of the tower 102. The remaining sections 106*b*-106*f* are generally referred to as "slidable" sections. This is because each additional section 106*b*-106*f* can slide within a larger section 106*a*-106*e*, respectively, of the tower 102. When the tower 102 is to be raised, the tower 102 is typically rotated on a tower support frame 114 attached to the trailer 104 so that the base 108 can sit on the ground or a support structure. One or more winches or other equipment 110 is then used to slide portions of the sections 106*b*-106*f* out of the larger sections 106*a*-106*e*, respectively. A reverse process could be used to lower the tower 102 for transport to another location or for storage.

The base 108 could have any suitable size, shape, and dimensions. For instance, the base 108 could have a triangular shape with 36" sides. The base 108 could also be formed from any suitable material(s), such as galvanized 4" by 4" by ¼" square steel tubing.

The equipment 110 includes any suitable equipment for raising and lowering the tower 102, such as one or more winches. For example, the equipment 110 could include a main drive motor and a direct-drive worm gear output with one or more reduction gear boxes. In particular embodiments, the equipment 110 includes a 1HP motor with two reduction gear boxes for a final reduction of 900:1. The motor could also be operated by hand, such as with a cordless drill, in case of a power or motor failure or theft of the motor. One or more limit switches, such as 10A switches, could be used with the motor.

The payload 112 represents any suitable components for supporting desired functions. This can include cellular, satellite, microwave, or other communication equipment, surveillance equipment, camera equipment, lighting equipment, or solar power equipment. Any suitable components and amount of payload 112 could also be placed on the tower 102, such as up to 1,000 pounds. When used to support communication services, the payload 112 could include equipment supporting 2G, 3G, 4G, CDMA, TDMA, LTE, GSM, or other communication technology or technologies.

The trailer 104 can be towed, such as by a truck or other vehicle, to a suitable location. The equipment 110 could then be used to raise the tower 102. The front portion of the trailer 104 includes space on which additional components, such as a generator for powering the payload 112 and fuel tanks for storing generator fuel, can be placed. The trailer 104 could have any suitable size, shape, and dimensions. For instance, the trailer 104 could be 18' long by 8'2" wide.

The trailer 104 could also include additional features. For example, the trailer 104 could include a diamond plate working deck. Also, an I-beam or other structure under the trailer 104 could be secured to the tower support frame 114. This can help secure the tower 102 to the trailer 104. Further, the trailer 104 could include tie down rails with stake pockets running the length of each side of the trailer 104, allowing users to secure any additional equipment that is added to the trailer 104. Moreover, a tie down strap system and a rubber Y block can be added to a front cradle area to secure the tower 102 while horizontal and in transit to protect the tower 102 from unneeded vibration and possible damage. In addition, outriggers can be provided along the edges or at the corners of the trailer 104 to help maintain the stability of the trailer 104, particularly when the tower 102 is raised. The trailer 104 could include any other or additional features according to particular needs.

In conventional telescopic towers, various components like Delrin guide blocks are used to help sections of the tower slide past one another. However, Delrin or other plastic parts can break, particularly when exposed to harsh environments commonly associated with towers. When this happens, metal components in the sections of the tower can actually rub against each other, causing damage and promoting corrosion of the tower components.

As described in more detail below, the tower 102 supports a guiding system that includes rollers, where each roller is attached to one section of the tower 102 and rolls against another section of the tower 102. In particular embodiments, the rollers could include steel sheaves, zinc-coated plates, and brass bushings. These rollers can help to ensure that the sections 106*b*-106*f* move smoothly within the sections 106*a*-106*e*, respectively, when the tower 102 is being raised or lowered. This can help to prevent damage and subsequent corrosion of the tower components.

Moreover, in conventional telescopic towers, one section of the tower typically must be fully extended before the next section of the tower can be extended. This can place unnecessary stress on the tower. Also, conventional telescopic towers cannot partially extend one or more sections of the tower. This can cause problems if payload needs to be raised to a specific height that cannot be obtained by raising one or more sections completely.

As described in more detail below, the tower 102 supports a lifting system that allows all slidable sections 106*b*-106*f* of the tower 102 to be extended or retracted simultaneously or near simultaneously. That is, the section 106*b* can slide out of the section 106*a* while the section 106*f* is sliding out of the section 106*e*. Note that this does not require all sections 106*b*-106*f* of the tower 102 to begin moving simultaneously, as there could be some small delay between when one section starts moving and when the next section starts moving. However, the lifting system does allow all tower sections 106*b*-106*f* to be extended or retracted at the same time.

In addition, there is no requirement that all sections 106*b*-106*f* of the tower 102 be completely extended out of the larger sections 106*a*-106*e*, respectively. This allows the tower 102 to be extended to any suitable height between its minimum and maximum heights. Depending on the implementation, the maximum height could be 60 feet, 80 feet, 106 feet, 120 feet, 150 feet, or other height.

Note that specific implementations of the system 100 need not include both the guiding system described below and the lifting system described below. That is, the guiding system described below could be implemented in a portable tower system without the lifting system described below, or vice versa.

The portable tower system 100 could be used in a wide variety of situations. For example, the system 100 could be used at special events such as sporting events, concerts, festivals, fairs, or rallies. The system 100 could also be used to provide communication services for short-term needs, such as at remote locations, new construction sites, or sites where security is needed. Further, the system 100 can be used during disaster recovery, such as during relief efforts for hurricanes, earthquakes, tornados, tsunamis, or floods. In addition, other uses could include surveillance, lighting, solar power, satellite communications, or any other suitable function. In general, the portable tower system 100 can be used in virtually any location where the tower 102 can be moved.

Although FIGS. 1A through 1C illustrate one example of a portable tower system 100, various changes may be made to FIGS. 1A through 1C. For example, the tower 102 could include a minimum of three sections, namely a base section and at least two slidable sections. Also, the tower 102 need not necessarily be used with a trailer 104 and could be transported in other ways. Further, while the sections 106*a*-106*f* of the tower 102 are shown as having a triangular cross-section, the sections 106*a*-106*f* of the tower 102 could have any other suitable shape. In addition, other or additional components could be used in the tower 102, such as guy wires.

FIGS. 2 through 8E illustrate an example guiding system in the portable tower system 100 of FIGS. 1A through 1C according to this disclosure. As noted above, the guiding system is used in the tower 102 to allow the tower sections 106*b*-106*f* to slide or otherwise move within the larger sections 106*a*-106*e*, respectively.

Figure 2:
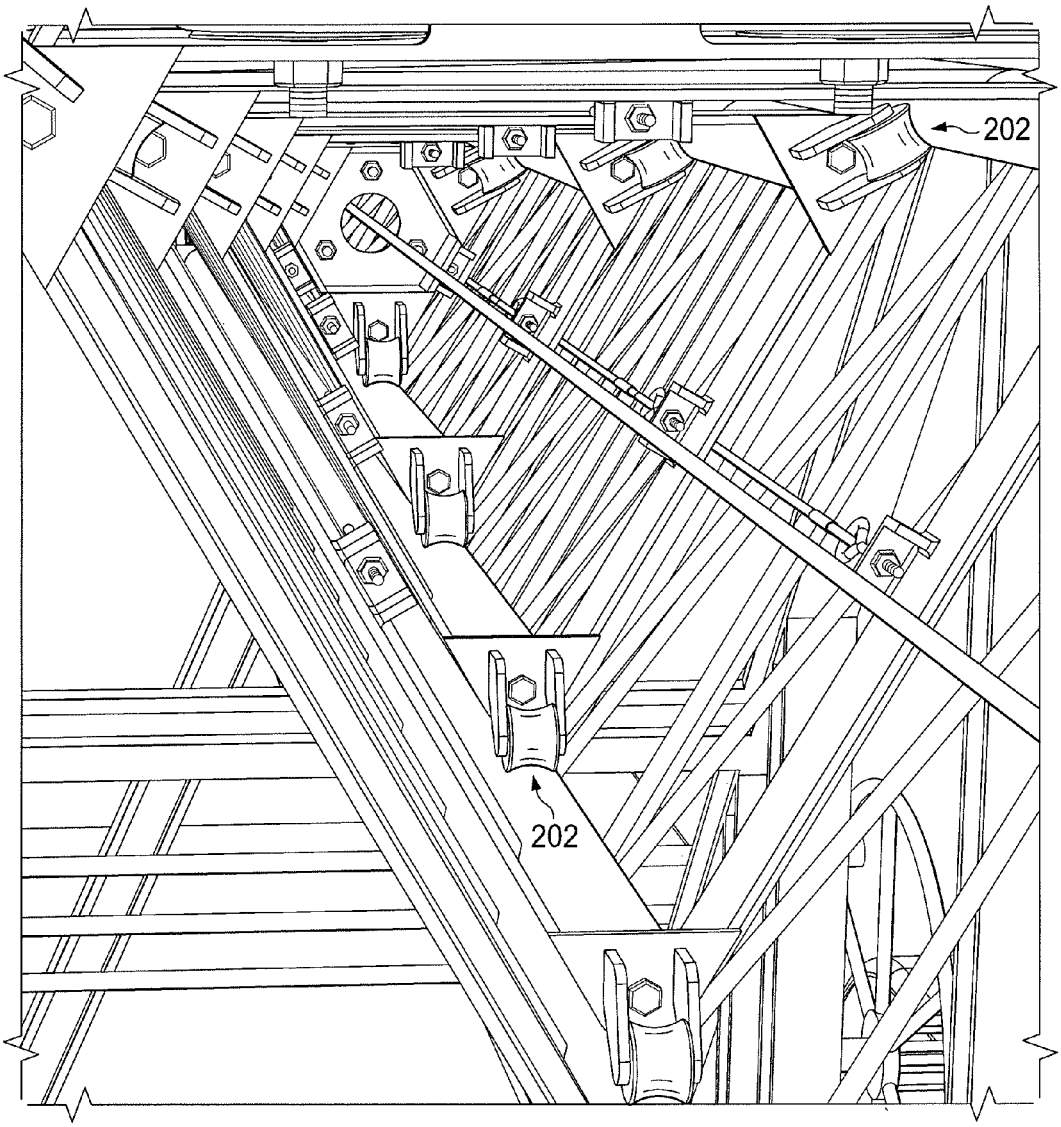
FIGS. 2 through 8E illustrate an example guiding system in the portable tower system of FIGS. 1A through 1C according to this disclosure.
Figure 3B:
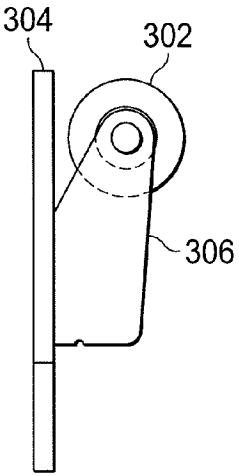
Figure 3E:
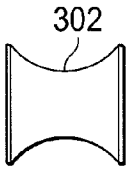
Figure 3D:
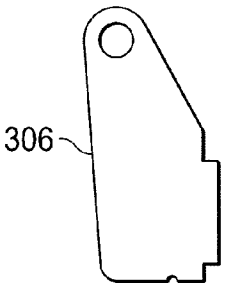
Figure 3A:
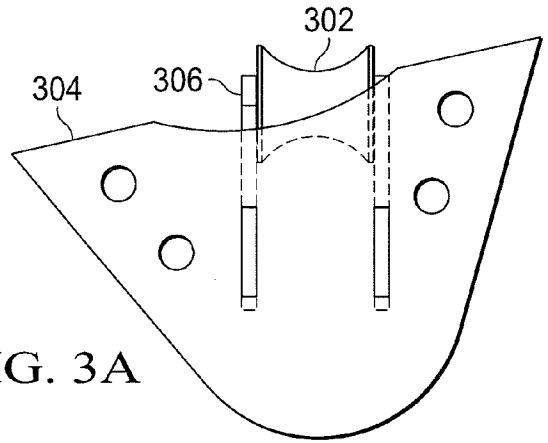
Figure 3C:
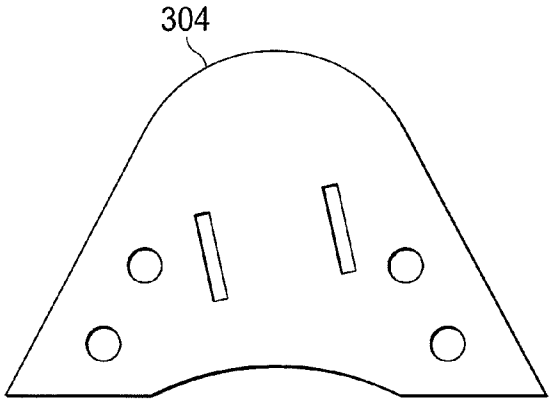
Figure 4B:
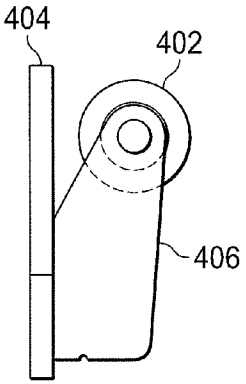
Figure 4E:
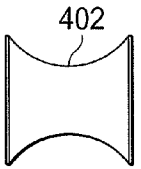
Figure 4D:
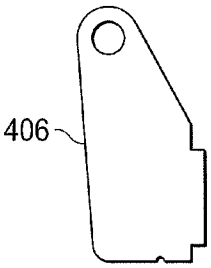
Figure 4A:
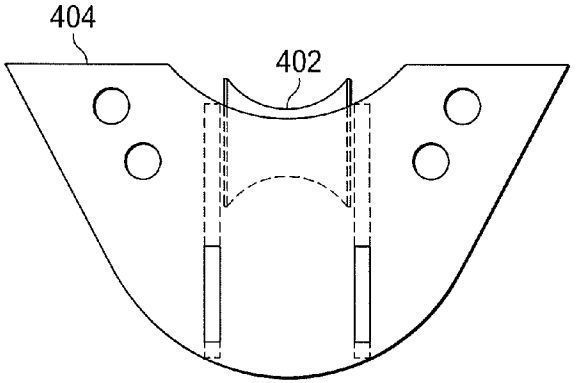
Figure 4C:
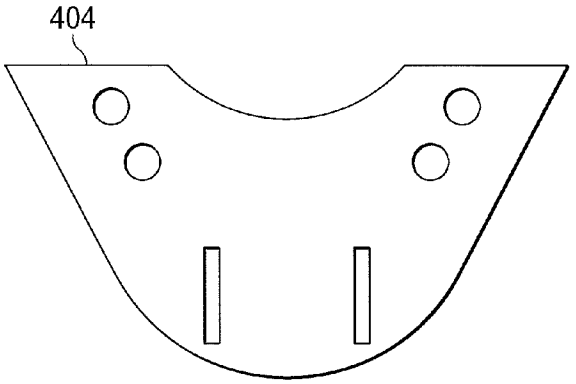
Figure 5A:
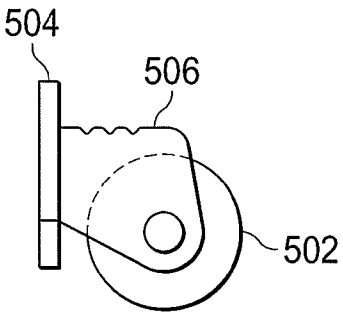
Figure 5B:
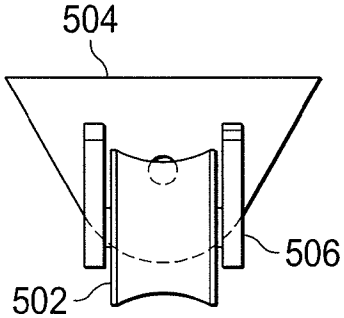
Figure 5C:
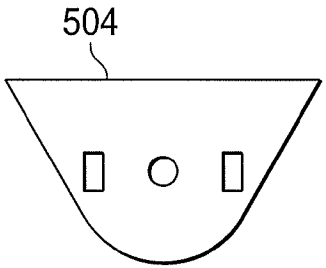
Figure 5D:
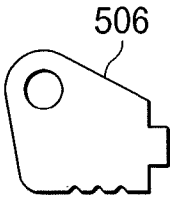
Figure 5E:
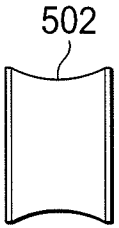
Figure 6B:
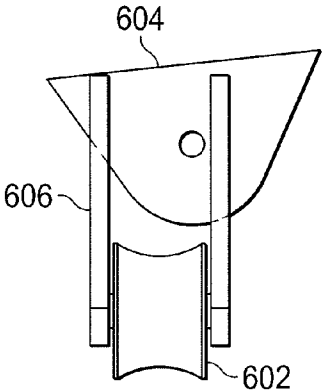
Figure 6E:
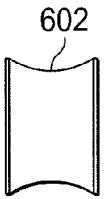
Figure 6D:
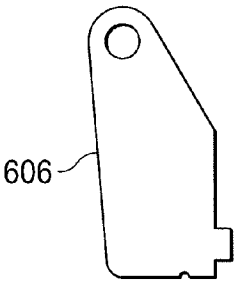
Figure 6A:
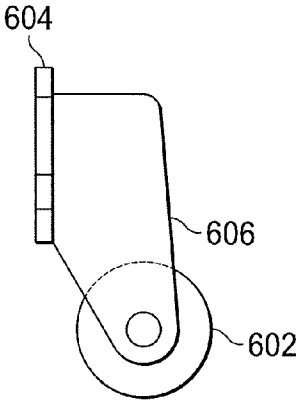
Figure 6C:
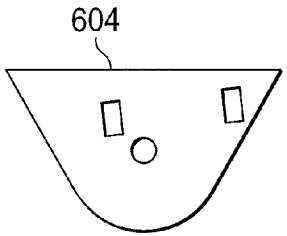
Figure 7C:
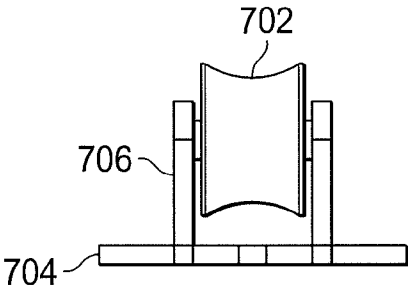
Figure 7F:
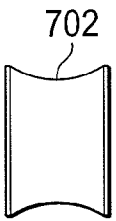
Figure 7B:
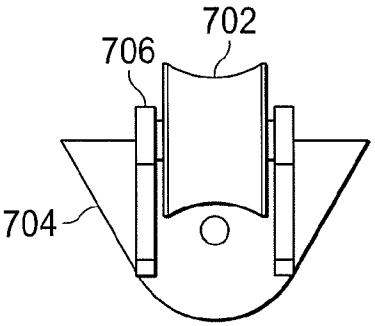
Figure 7E:
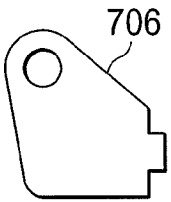
Figure 7A:
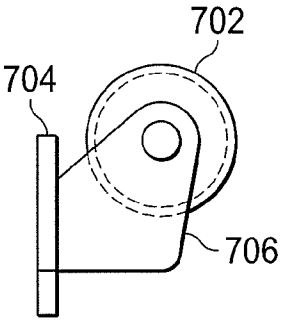
Figure 7D:
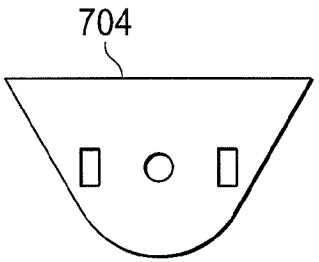
Figure 8A:
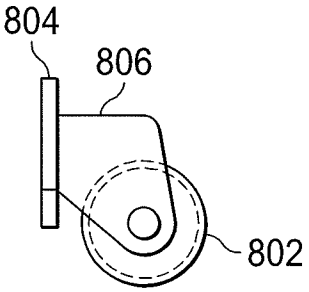
Figure 8B:
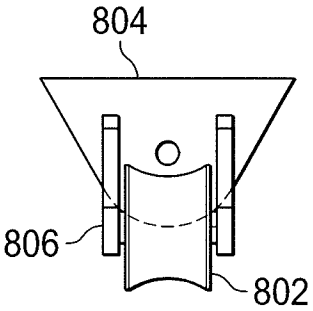
Figure 8C:
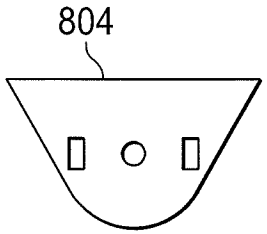
Figure 8D:
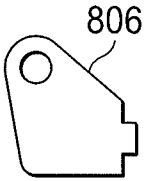
Figure 8E:
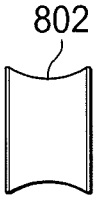

FIG. 2 illustrates a view of the tower 102 from a bottom of the tower 102 when the tower 102 has been retracted. As can be seen in FIG. 2, various sections of the tower 102 include rollers 202. Each roller 202 is connected to one section of the tower 102 and rolls along a vertical bar of another section of the tower 102.

In this particular view, the rollers 202 are located at the bottom corners of the sections 106*b*-106*f*. However, additional rollers can be used in other locations. For instance, rollers 202 can also be used at top corners of the sections 106*a*-106*e* (these rollers can be seen in FIGS. 1A and 1B at the top corners of the sections 106*a*-106*e*). The rollers 202 allow each section 106*b*-106*f* to roll smoothly within a larger section 106*a*-106*e*, respectively. The rollers 202 also help to ensure that each section 106*b*-106*f* remains substantially centered within a larger section 106*a*-106*e*, respectively. This helps to provide precise spacing between each section of the tower 102, allowing for smoother raising and lowering of the tower 102.

In particular embodiments, the tower 102 includes thirty rollers 202. Fifteen rollers 202 can be located at top corners of the sections 106*a*-106*e*, and fifteen rollers 202 can be located at bottom corners of the sections 106*b*-106*f*. Note that "top" or "upper" and "bottom" or "lower" here refer to the relative ends of the tower sections when the tower is in a raised position.

The rollers 202 in the tower 102 may or may not have the same size. For example, rollers 202 connected to higher tower sections could be smaller than rollers 202 connected to lower tower sections. Among other things, the lower tower sections could be fabricated from thicker pipes or tubes, and larger rollers may be used to roll along those larger tubes or pipes.

FIGS. 3A through 8E illustrate examples of the rollers 202 that can be used to guide the various sections of the tower 102 when the tower 102 is being raised or lowered. FIGS. 3A through 3E illustrate rollers 202 that could be used on the tower section 106*a* and that roll against the tower section 106*b*. FIGS. 4A through 4E illustrate rollers 202 that could be used on the tower section 106*b* and that roll against the tower section 106*a*. The rollers 202 in FIGS. 3A through 3E could be used at the top corners of the tower section 106*a*, and the rollers 202 in FIGS. 4A through 4E could be used at the bottom corners of the tower section 106*b*.

FIGS. 5A through 5E illustrate rollers 202 that could be used on the tower section 106*b* and that roll against the tower section 106*c*. FIGS. 6A through 6E illustrate rollers 202 that could be used on the tower section 106*c* and that roll against the tower section 106*d*. The rollers 202 in FIGS. 5A through 5E could be used at the top corners of the tower section 106*b*, and the rollers 202 in FIGS. 6A through 6E could be used at the bottom corners of the tower section 106*c*.

FIGS. 7A through 7F illustrate rollers 202 that could be used on the tower sections 106*c*-106*e* and that roll against the tower sections 106*d*-106*f*, respectively. These rollers 202 could be used in the tower 102 at the top corners of the sections 106*c*-106*e*. FIGS. 8A through 8E illustrate rollers 202 that could be used on the tower sections 106*d*-106*f* and that roll against the tower sections 106*c*-106*e*, respectively. These rollers 202 could be used in the tower 102 at the bottom corners of the sections 106*d*-106*f*.

Referring to FIGS. 3A through 3E as an example, each roller 202 can include a sheave 302, a base plate 304, and a bushing 306. The sheave 302 is coupled to the bushing 306. The plate 304 is coupled to a corner or other portion of a tower section 106*a*-106*f*. The bushing 306 connects the sheave 302 to the plate 304 and allows the sheave 302 to rotate freely. The sheave 302 is recessed, allowing the sheave 302 to travel easily along a vertical bar of a tower section.

Each component 302-306 could be formed from any suitable material(s) and in any suitable manner. For example, the sheave 302 could be formed from galvanized steel, the plate 304 could represent a zinc-coated plate, and the bushing 306 could be formed from brass. The rollers shown in FIGS. 4A through 8E can have similar designs (containing sheaves 402-802, plates 404-804, and bushings 406-806) with somewhat different shapes and sizes.

Although FIGS. 2 through 8E illustrate one example of a guiding system in the portable tower system 100 of FIGS. 1A through 1C, various changes may be made to FIGS. 2 through 8E. For example, while the tower sections 106*a*-106*f* are shown as being triangular in cross-section, each section 106*a*-106*f* could have any other suitable cross-sectional shape. Also, the specific rollers 202 shown here and their shapes, sizes, and dimensions are for illustration only.

FIGS. 9 through 14 illustrate an example lifting system in the portable tower system of FIGS. 1A through 1C according to this disclosure. As noted above, the lifting system is used in the tower 102 to extend and retract the tower sections 106*b*-106*f*.

Figure 9:
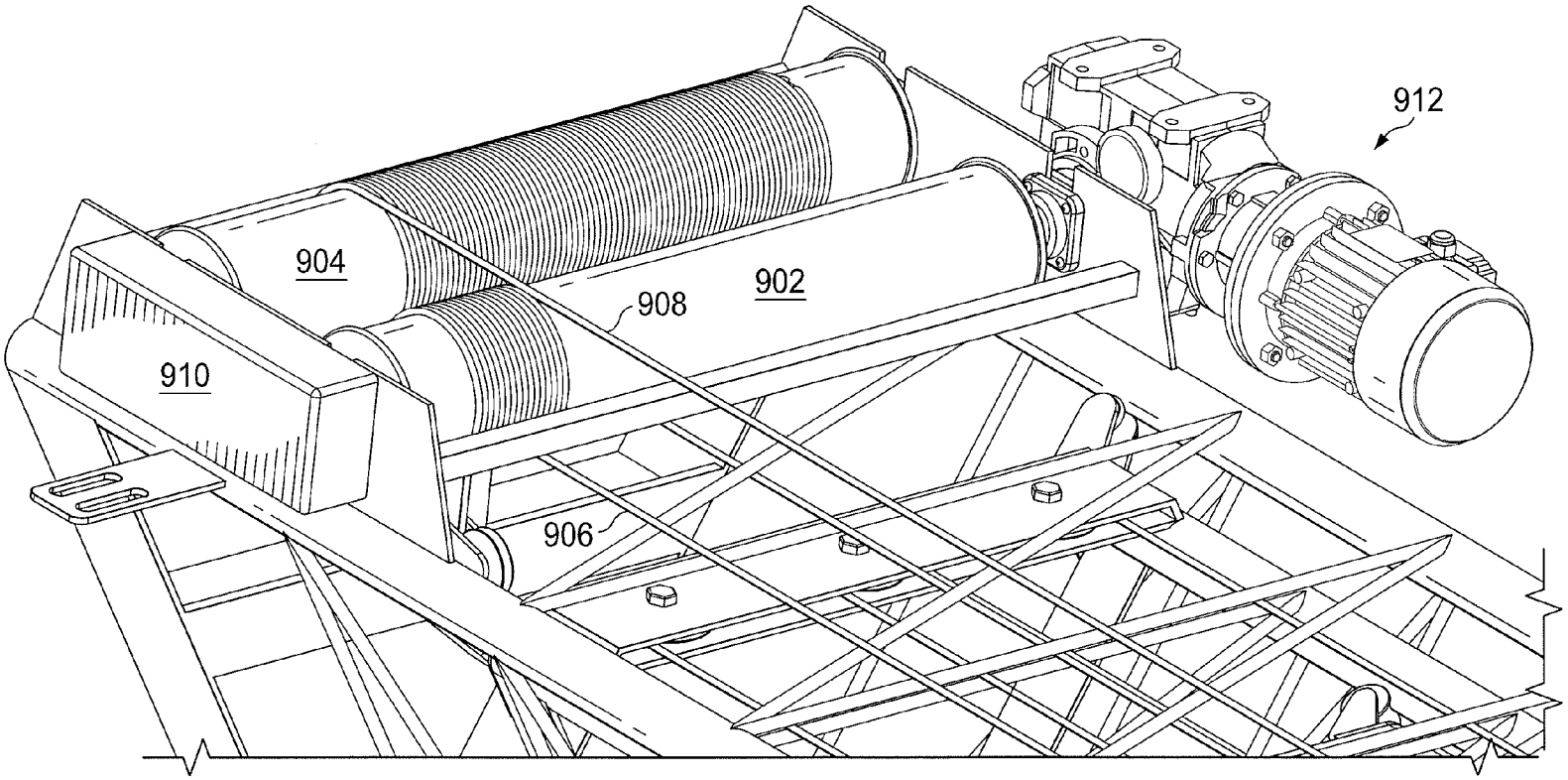
FIGS. 9 through 14 illustrate an example lifting system in the portable tower system of FIGS. 1A through 1C according to this disclosure.

FIG. 9 illustrates a portion of the equipment 110 on the trailer 104 of the portable tower system 100. In this example, two drums 902-904 are shown attached to two cables 906-908.

The drum 902 represents a primary drum around which a primary cable 906 is wound. As described below, the primary cable 906 can be routed around and across various pulleys in different sections of the tower 102. For example, the primary cable 906 could be routed around and across various pulleys in the tower sections 106*a*-106*b* and anchored on the tower section 106*a*. The primary drum 902 provides the bulk of the lifting force needed to raise the tower 102.

The drum 904 represents a secondary drum around which a secondary cable 908 is wound. As described below, the secondary cable 908 can also be routed around and across various pulleys in one or more sections of the tower 102. For example, the secondary cable 908 can be routed around and across various pulleys in the tower section 106*a* and then attached to a tension spring 116 located in the tower section 106*f* (as shown in FIG. 1C). The secondary drum 904 provides a force for holding the tower sections 106*b*-106*f* substantially in place if the primary cable 906 ever fails.

Each drum 902-904 represents any suitable structure around which a cable can be wound. As particular examples, the drum 902 could represent a 6" by 29.5" drum, and the drum 904 could represent a 6" by 31.5" drum. Each cable 906-908 represents any suitable cable for applying force to one or more sections of a tower. As particular examples, the cable 906 could represent a ⅜" by 140' cable, and the cable 908 could represent a 5/16" by 160' cable.

On the left side of the drums 902-904 in FIG. 9 is a box 910 in which a chain or other connector is placed. An actual connector 150 can be seen in FIG. 1B on the side of the two drums. This connector 150 connects the drums 902-904 so that rotation of one drum causes rotation of the other drum. In some embodiments, the primary drum 902 is rotated by a motor 912, and the connector 150 causes the secondary drum 904 to rotate.

Figure 10:
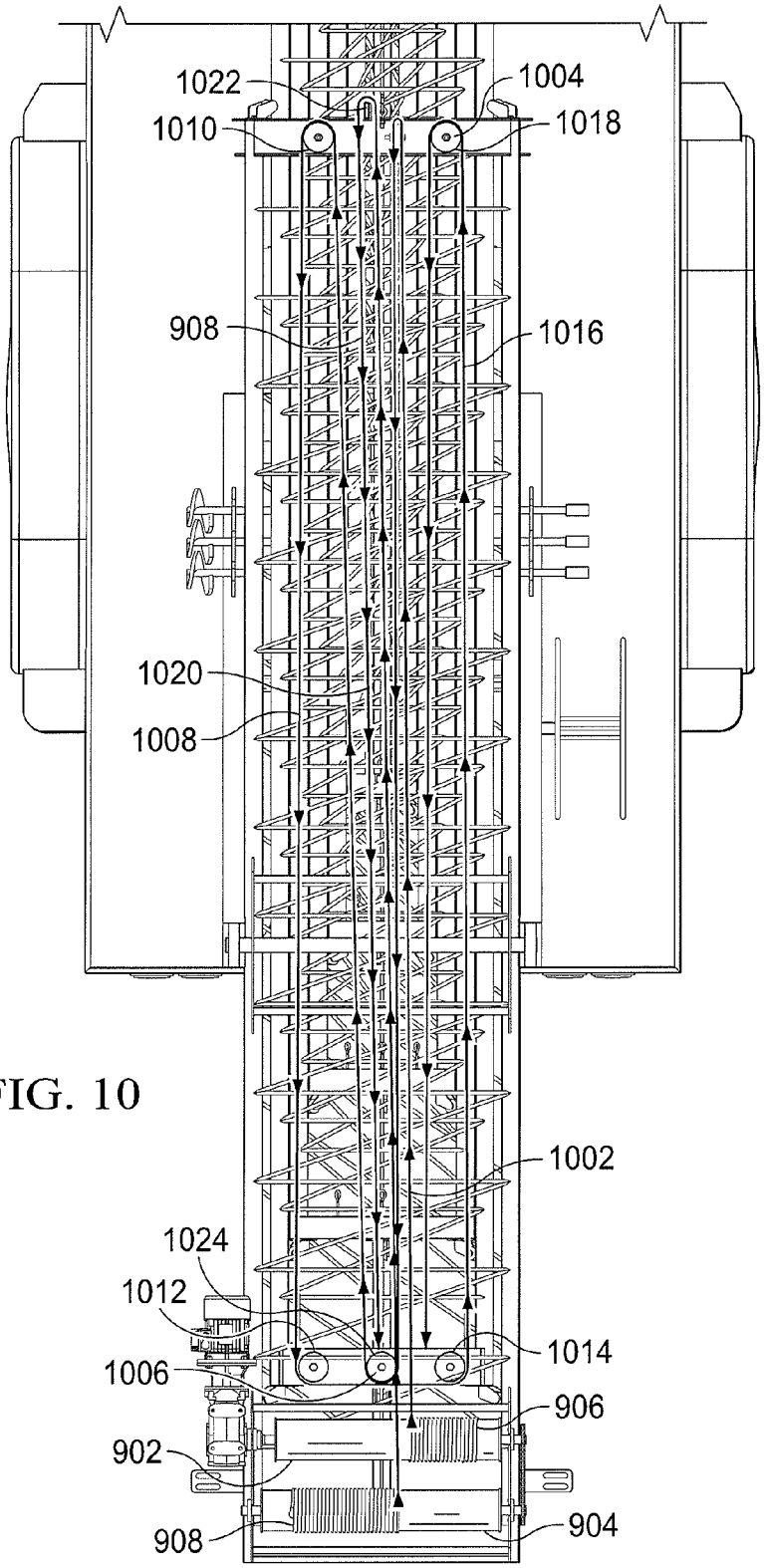

FIG. 10 illustrates details of an example pulley system that can be used in conjunction with the primary and secondary cables 906-908. As shown in FIG. 10, the primary cable 906 leaves the primary drum 902 and travels a path 1002 up to a pulley 1004 and back down. The pulley 1004 is mounted at or near the top of the tower section 106*a*. The primary cable 906 then loops around a pulley 1006 located at or near the bottom of the tower section 106*b*. The primary cable 906 then travels a path 1008 up to a pulley 1010 located at or near the top of the tower section 106*a* and back down. The primary cable 906 then loops around a pulley 1012 and a pulley 1014 located at or near the bottom of the tower section 106*b*. The primary cable 906 then travels a path 1016 up to a pulley 1018 located at or near the top of the tower section 106*a* and back down. Finally, the primary cable 906 is anchored at or near the bottom of the tower section 106*b*.

When the drum 902 rotates in one direction and pulls on the primary cable 906, the primary cable 906 imparts a lifting force to the tower section 106*b*. As described below, additional cables connecting the tower sections 106*a*-106*e* to the tower sections 106*b*-106*f*, respectively, impart a lifting force to the tower sections 106*c*-106*f*. This provides the primary lifting force for extending the tower sections 106*b*-106*f* substantially simultaneously. When the tower sections 106*b*-106*f* are to be retracted, the drum 902 is rotated in the opposite direction to release the primary cable 906.

The secondary cable 908 leaves the secondary drum 904 and travels a path 1020 up to a pulley 1022 and back down. The pulley 1022 is mounted at or near the top of the tower section 106*a*. The secondary cable 908 then contacts two pulleys 1024 (shown in greater detail below). The pulleys 1024 position the secondary cable 908 so that the secondary cable 908 can travel up substantially through a center of the tower 102 to a tension spring mounted to the tower section 106*f*. The secondary cable 908 running through the center of the tower 102 can be seen in FIG. 2.

The various pulleys described here could represent any suitable pulley devices. For example, the various pulleys in lower sections of the tower 102 could represent 6" by 1" by 6000 pound zinc-plated sheaves with brass bushings. Pulleys in upper sections of the tower 102 could represent 3" by 5/16" by 2000 pound sheaves with brass bushings.

Figure 11:
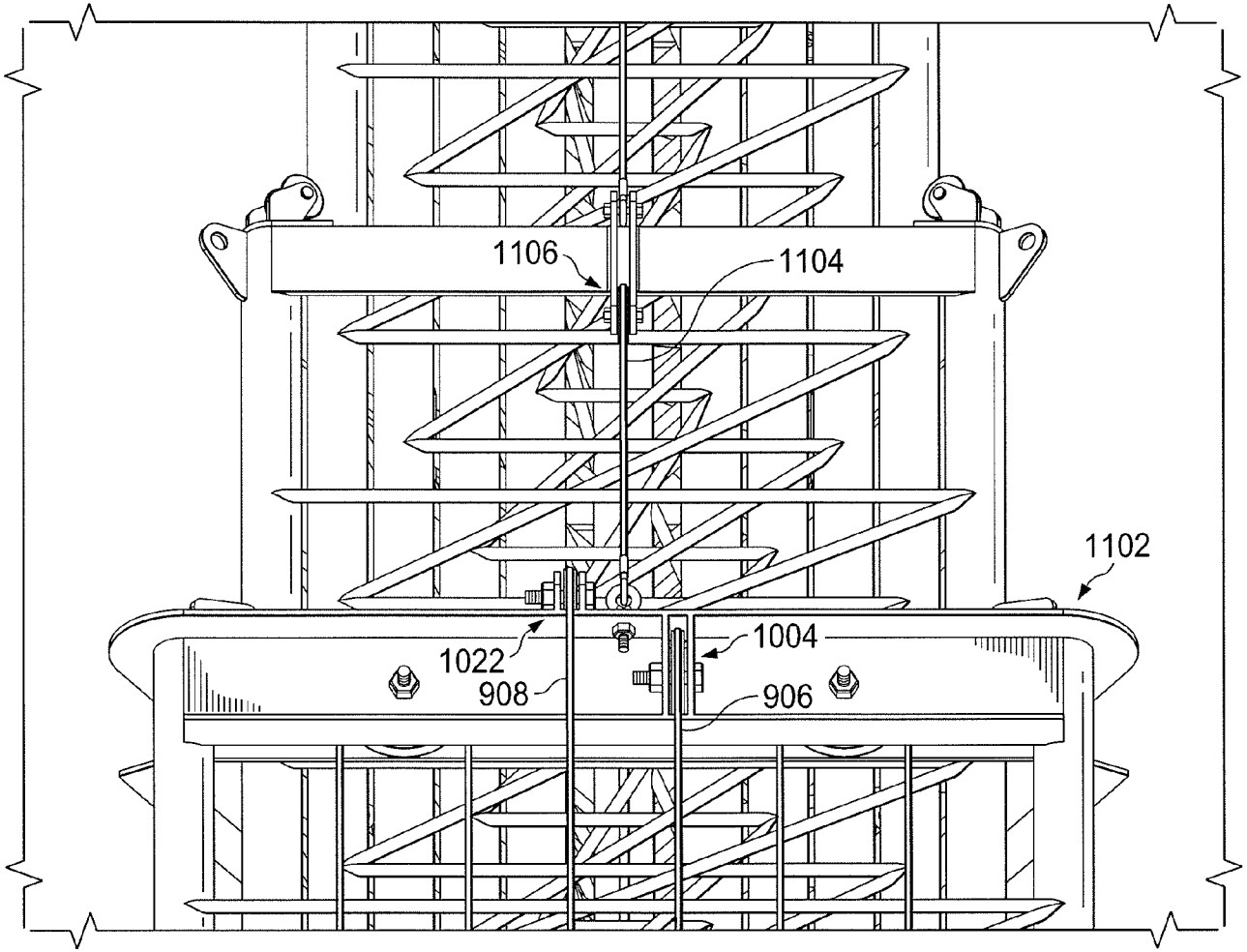

FIG. 11 illustrates the pulley 1004 located at or near a top 1102 of the base tower section 106*a*. The primary cable 906 loops around the pulley 1004 as it follows the path 1002. FIG. 11 also illustrates the pulley 1022 located at or near the top 1102 of the base tower section 106*a*. The secondary cable 908 loops around the pulley 1022 as it follows the path 1020.

In addition, a cable 1104 here is secured to the tower section 106*a* at or near the top 1102 of the tower section 106*a*. This cable 1104 loops around a pulley 1106 mounted to the tower section 106*b* and is eventually secured to the tower section 106*b* (such as at or near a bottom of the tower section 106*b*). A similar arrangement can be used on all sides of each tower section 106*a*-106*e* to couple those tower sections 106*a*-106*e* to the tower sections 106*b*-106*f*, respectively.

Figure 12:
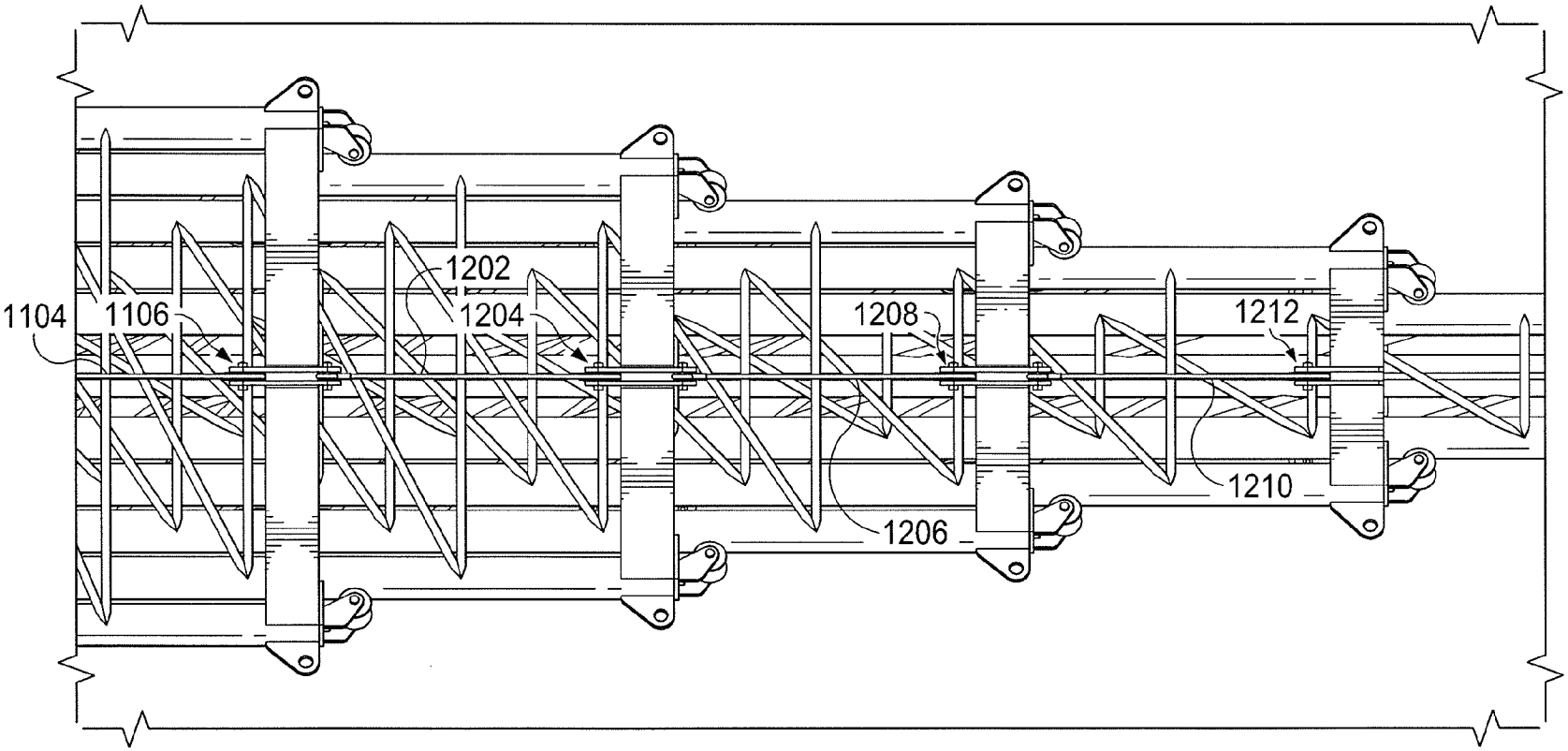

In FIG. 12, for example, a cable 1202 is secured at or near the top of the tower section 106*b*, loops around a pulley 1204 on the tower section 106*c*, and is eventually secured to the tower section 106*c* (such as at or near a bottom of the tower section 106*c*). A cable 1206 is secured at or near the top of the tower section 106*c*, loops around a pulley 1208 on the tower section 106*d*, and is eventually secured to the tower section 106*d* (such as at or near a bottom of the tower section 106*d*). A cable 1210 is secured at or near the top of the tower section 106*d*, loops around a pulley 1212 on the tower section 106*e*, and is eventually secured to the tower section 106*e* (such as at or near a bottom of the tower section 106*e*). A similar arrangement can be used to couple the tower sections 106*e*-106*f*. Moreover, a similar arrangement can be used to couple all sides of the tower sections 106*a*-106*e* to corresponding sides of the tower sections 106*b*-106*f*.

Each of these cables 1104, 1202, 1206, 1210, and so on can be coupled to a tower section in any suitable manner. For example, these cables can be coupled to a tower section using various connectors 204 as shown in FIG. 2.

The cables connecting two adjacent sections of the tower 102 form a set, and multiple sets of cables are used to raise and lower the sections 106*b*-106*f* substantially at the same time. For example, the tower section 106*b* begins to rise when the primary cable 906 is retracted using the drum 902. When the tower section 106*b* begins to rise, the cables 1104 connected to the tower section 106*a* pull on the tower section 106*b*, helping to raise the tower section 106*b*. Similarly, the cables 1202 connected to the tower section 106*b* pull on the tower section 106*c*, helping to raise the tower section 106*c*. The cables 1206 connected to the tower section 106*c* pull on the tower section 106*d*, helping to raise the tower section 106*d*. The cables 1210 connected to the tower section 106*d* pull on the tower section 106*e*, helping to raise the tower section 106*e*. Finally, similar cables connected to the tower section 106*e* pull on the tower section 106*f*, helping to raise the tower section 106*f*.

Figure 13:
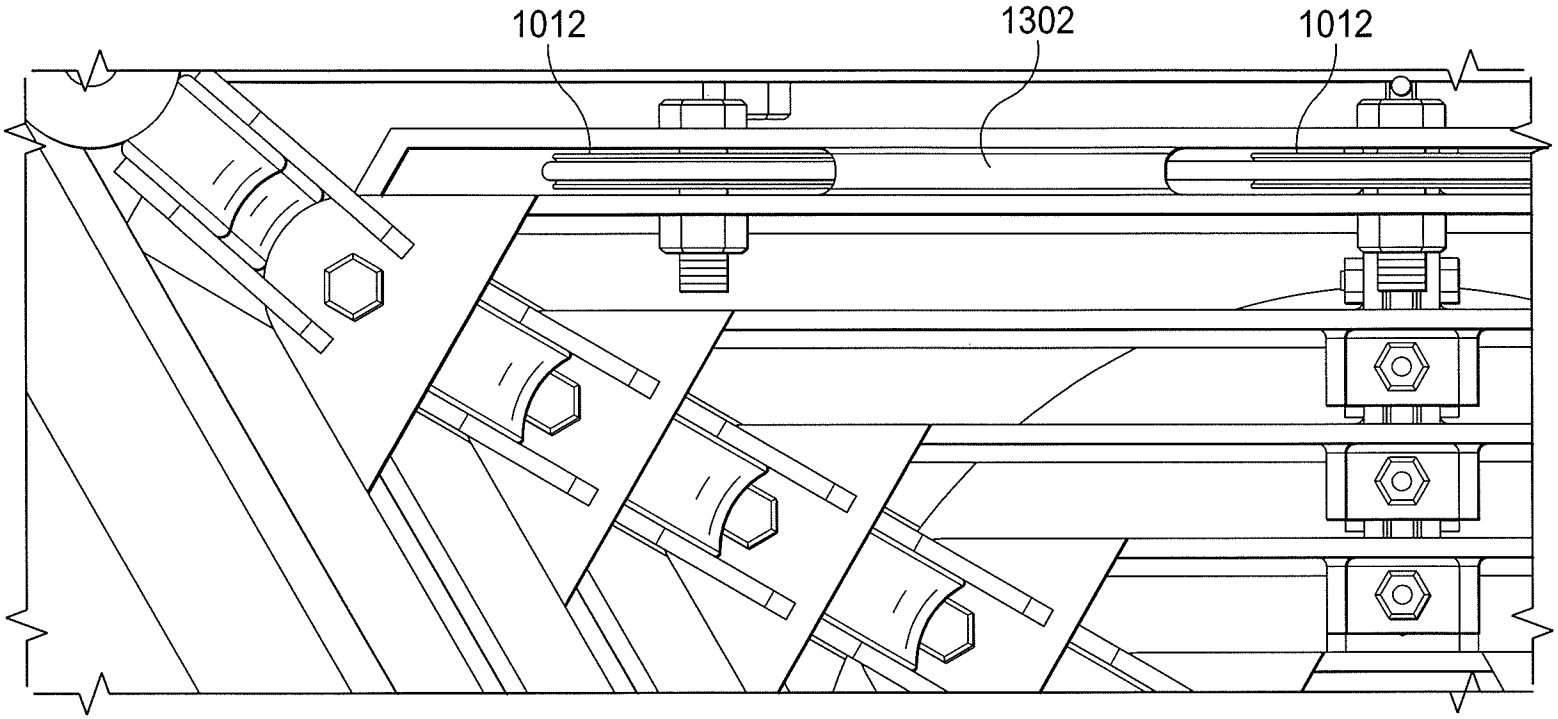

FIG. 13 illustrates the pulleys 1012 and 1006 secured in a base 1302 of the tower section 106*b*. Although not shown, the pulley 1014 can be secured in the base 1302 of the tower section 106*b* in a similar manner.

Figure 14:
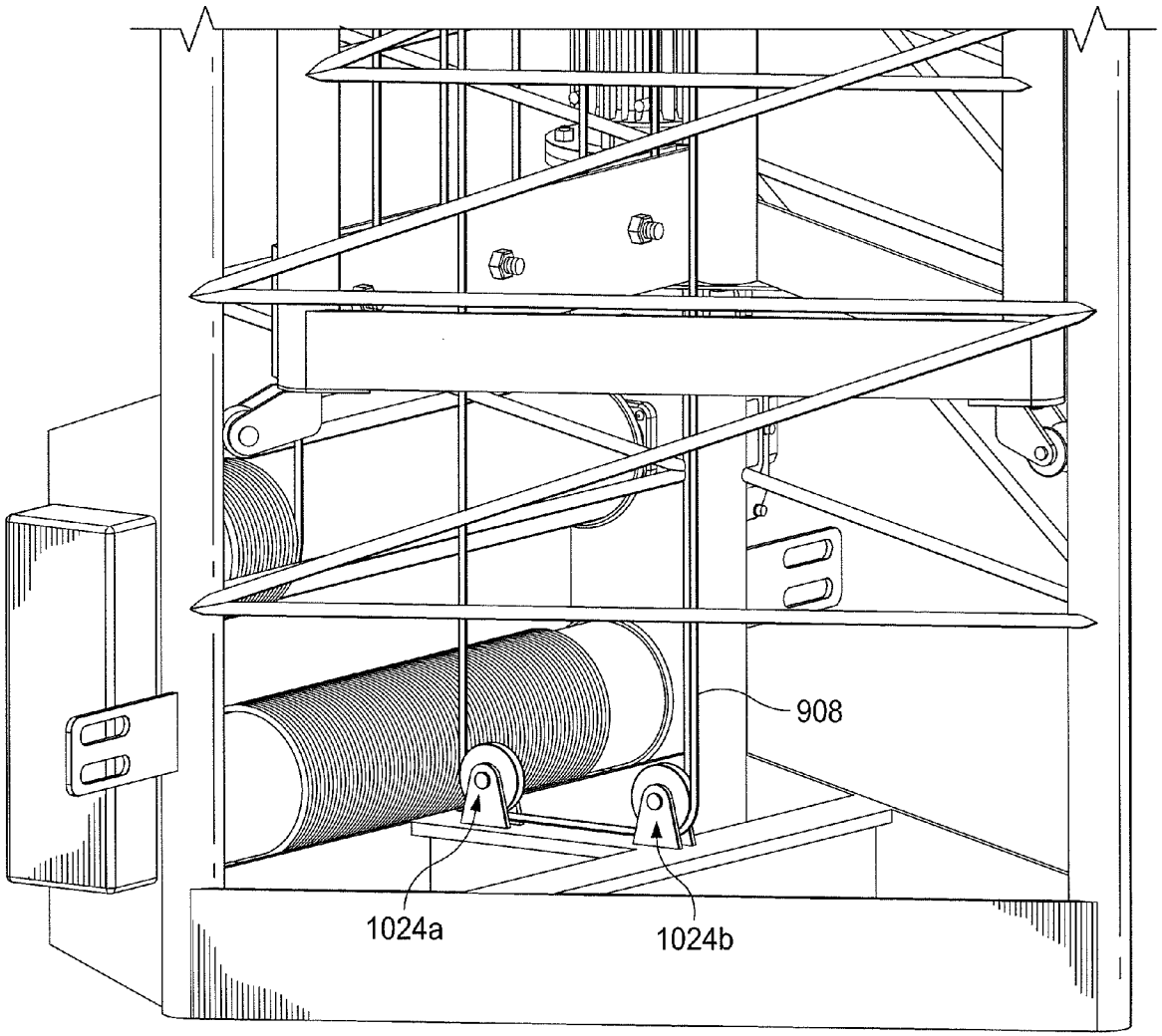

FIG. 14 illustrates the two pulleys 1024, referred to as pulleys 1024*a*-1024*b*. These pulleys 1024*a*-1024*b* are used to position the secondary cable 908 to travel substantially through a central area of the tower 102 up to a tension spring in the tower section 106*f*.

Although FIGS. 9 through 14 illustrate one example of a lifting system in the portable tower system 100 of FIGS. 1A through 1C, various changes may be made to FIGS. 9 through 14. For example, the various paths taken by the cables 906-908 could be modified according to particular needs. Also, while certain pulleys are shown as being located in specified positions, the positions of various pulleys could be modified according to particular needs.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a portable tower comprising multiple sections including a base section and at least two slidable sections, the at least two slidable sections including a bottommost slidable section and at least one additional slidable section, the multiple sections forming a nested telescopic structure;

the tower also comprising a lifting system configured to extend the at least two slidable sections substantially simultaneously, wherein the lifting system comprises:

a first cable routed around multiple first pulleys connected to the base section and to the bottommost slidable section, the first cable anchored to the bottommost slidable section; and one or more sets of second cables, each set of second cables anchored to two adjacent ones of the at least two slidable sections;

wherein the first cable is configured to extend the bottommost slidable section; and wherein the one or more sets of second cables are configured to extend the at least one additional slidable section in response to the extension of the bottommost slidable section.

2. The apparatus of claim 1, wherein the lifting system further comprises:

a third cable routed around multiple second pulleys mounted to the base section and coupled to a tension spring in a topmost slidable section of the at least one additional slidable section.

3. The apparatus of claim 2, wherein the lifting system further comprises:

a first drum around which at least part of the first cable is wound; and a second drum around which at least part of the third cable is wound.

4. The apparatus of claim 3, wherein the lifting system further comprises:

a connector configured to cause one of the drums to rotate when another of the drums rotates.

5. The apparatus of claim 2, wherein the first pulleys comprise three pulleys mounted to the base section and three pulleys mounted to the bottommost slidable section.

6. The apparatus of claim 2, wherein the second pulleys comprise three pulleys mounted to the base section.

7. The apparatus of claim 1, wherein the first cable is not routed around any additional pulleys connected to any of the at least one additional slidable section.

8. The apparatus of claim 1, wherein:

each of the base and slidable sections of the tower has a triangular cross-section with three sides; and each of the sets of second cables includes three cables coupling the three sides of two adjacent sections of the slidable sections.

9. The apparatus of claim 1, wherein each of the base and slidable sections of the tower includes multiple rollers configured to roll against another of the sections of the tower.

10. The apparatus of claim 9, wherein:

the base section includes multiple first rollers at upper corners of the base section;

the bottommost slidable section includes multiple second rollers at lower corners and upper corners of the bottommost slidable section; and a topmost slidable section of the at least one additional slidable section includes multiple third rollers at lower corners of the topmost slidable section.

11. A system comprising:

a portable tower comprising multiple sections including a base section and at least two slidable sections, the at least two slidable sections including a bottommost slidable section and at least one additional slidable section, the multiple sections forming a nested telescopic structure; and a trailer on which the portable tower in mounted;

wherein the tower comprises a lifting system configured to extend the at least two slidable sections substantially simultaneously, wherein the lifting system comprises:

a first cable routed around multiple first pulleys connected to the base section and to the bottommost slidable section, the first cable anchored to the bottommost slidable section; and one or more sets of second cables, each set of second cables anchored to two adjacent ones of the at least two slidable sections;

wherein the first cable is configured to extend the bottommost slidable section; and wherein the one or more sets of second cables are configured to extend the at least one additional slidable section in response to the extension of the bottommost slidable section.

12. The system of claim 11, wherein the lifting system further comprises:

a third cable routed around multiple second pulleys mounted to the base section and coupled to a tension spring in a topmost slidable section of the at least one additional slidable section.

13. The system of claim 12, wherein the lifting system further comprises:

a first drum around which at least part of the first cable is wound; and a second drum around which at least part of the third cable is wound.

14. The system of claim 12, wherein the first pulleys comprise three pulleys mounted to the base section and three pulleys mounted to the bottommost slidable section.

15. The system of claim 12, wherein the second pulleys comprise three pulleys mounted to the base section.

16. The system of claim 11, wherein the first cable is not routed around any additional pulleys connected to any of the at least one additional slidable section.

17. The system of claim 11, wherein:

each of the base and slidable sections of the tower has a triangular cross-section with three sides; and each of the sets of second cables includes three cables coupling the three sides of two adjacent sections of the slidable sections.

18. The system of claim 11, wherein each of the base and slidable sections of the tower includes multiple rollers configured to roll against another of the sections of the tower.

19. The system of claim 18, wherein:

the base section includes multiple first rollers at upper corners of the base section;

the bottommost slidable section includes multiple second rollers at lower corners and upper corners of the bottommost slidable section; and a topmost slidable section of the at least one additional slidable section includes multiple third rollers at lower corners of the topmost slidable section.

20. An apparatus comprising:

a portable tower comprising multiple sections including a base section and at least two slidable sections, the at least two slidable sections including a bottommost slidable section and at least one additional slidable section, the multiple sections forming a nested telescopic structure; and a lifting system;

wherein each base and slidable section of the tower includes multiple rollers configured to roll against another of the sections of the tower;

wherein the lifting system comprises:

a first cable routed around multiple first pulleys connected to the base section and to the bottommost slidable section, the first cable anchored to the bottommost slidable section; and one or more second cables, each second cable anchored to two adjacent ones of the at least two slidable sections;

wherein the first cable is configured to extend the bottommost slidable section; and wherein the one or more second cables are configured to extend the at least one additional slidable section in response to the extension of the bottommost slidable section.

21. The apparatus of claim 20, wherein:

the base section includes multiple first rollers at upper corners of the base section;

the bottommost slidable section includes multiple second rollers at lower corners and upper corners of the bottommost slidable section; and a topmost slidable section of the at least one additional slidable section includes multiple third rollers at lower corners of the topmost slidable section.

* * * * *